US006922148B2

(12) United States Patent
Despotis

(10) Patent No.: US 6,922,148 B2
(45) Date of Patent: Jul. 26, 2005

(54) PATIENT IDENTIFICATION SYSTEM

(76) Inventor: George J. Despotis, 12511 Elaine Dr., Des Peres, MO (US) 63131

( * ) Notice: Subject to any disclaimer, the term of this patent is extended or adjusted under 35 U.S.C. 154(b) by 0 days.

(21) Appl. No.: 10/353,873

(22) Filed: Jan. 29, 2003

(65) Prior Publication Data

US 2004/0145480 A1 Jul. 29, 2004

(51) Int. Cl.[7] ..... G08B 23/00
(52) U.S. Cl. ..... 340/573.1; 340/539.13; 340/539.15; 340/568.1; 340/572.1
(58) Field of Search ..... 340/568.1, 572, 340/572.9, 573.4, 571, 572.3, 573.1

(56) References Cited

U.S. PATENT DOCUMENTS 3,059,359 A * 10/1962 Goldammer et al. ..... 40/633
3,978,318 A 8/1976 Romeo
4,121,574 A * 10/1978 Lester ..... 600/479
4,154,011 A 5/1979 Rakestraw
4,164,320 A 8/1979 Irazoqui
4,512,096 A 4/1985 Heidecker
4,598,275 A * 7/1986 Ross et al. ..... 340/573.4
4,736,196 A * 4/1988 McMahon et al. ..... 340/573.4
4,783,917 A * 11/1988 Smith et al. ..... 40/633
4,812,823 A * 3/1989 Dickerson ..... 340/573.4
4,914,843 A 4/1990 DeWoskin
4,939,652 A * 7/1990 Steiner ..... 701/35
5,002,212 A 3/1991 Charleton
5,014,040 A * 5/1991 Weaver et al. ..... 340/568.1
5,075,670 A * 12/1991 Bower et al. ..... 340/573.4
5,115,223 A * 5/1992 Moody ..... 340/573.1
5,323,554 A 6/1994 MacDonald
5,343,608 A 9/1994 MacDonald
5,873,188 A * 2/1999 Gehris ..... 40/633
5,917,407 A * 6/1999 Squire et al. ..... 340/432
5,939,988 A * 8/1999 Neyhart ..... 340/573.4
5,979,095 A * 11/1999 Schneider et al. ..... 40/633
6,028,519 A 2/2000 Dessureau
6,031,460 A * 2/2000 Banks ..... 340/573.1
6,433,689 B1 8/2002 Hovind

OTHER PUBLICATIONS

"What is Smart® & RFID?".
SG, "Mobile Medical Monitoring," *Application IDEAS*, Nov. 2002, p. 22.
Raytek MX Series Infrared Thermoter.
I–TRAC Plus System.

* cited by examiner

*Primary Examiner*—Thomas J. Mullen, Jr.
*Assistant Examiner*—Son Tang
(74) *Attorney, Agent, or Firm*—Todd S. Parkhurst

(57) ABSTRACT

A patient identification system is disclosed that solves several problems associated with current ID bands such as easy removal, loss and inefficient patient identification. The patient identification system comprises an identification bracelet that is difficult to remove and has a lock and an identification mechanism. Further, the identification bracelet may require a separate unlocking device to unlock the lock. The unlocking device may also have a means to track how long the bracelet has been unlocked, an alarm system, and a display screen.

5 Claims, 2 Drawing Sheets

PATIENT IDENTIFICATION SYSTEM

TECHNICAL FIELD OF THE INVENTION

The present invention relates, in general, to the field of patient identification devices and, in particular, to a system which prevents removal of the device from the patient without the appropriate unlocking mechanism, and which improves accuracy of patient identification.

BACKGROUND OF THE INVENTION

In recent years, hospitals and health care facilities have dealt with increasing incidents of patient identity confusion, miscommunication among caregivers regarding treatment, and incorrect blood and drug administration as a result of the failures of existing identification devices. These problems have become so pervasive that the Joint Commission on Accreditation of Healthcare Organizations (JCAHO) has called a National Patient Safety Goals Conference to convey the gravity of the situation, provide guidance and attempt to reduce such healthcare problems.

Such problems arise because existing identification (ID) bands fail to address several common issues. Patients, doctors, nurses or anyone can easily remove current ID bands. For example, patients cut or tear off the bands when they feel uncomfortable. As a result, doctors and nurses cannot identify the patient in an emergency. Moreover, this increases costs by requiring replacements and decreases healthcare workers' efficiency by adding additional administrative duties.

In addition, doctors and hospital workers also remove these ID bands even when it is unnecessary to do so. In fact, they cut the bands merely for their own convenience during insertion of intravenous or intra-arterial catheters or during surgery. Unauthorized removals result in wasted resources spent for replacement and a waste of time spent for identifying and reacquiring a new bracelet.

Furthermore, doctors routinely remove the ID bands prior to procedures involving extremities or when blood flow to an extremity is compromised by swelling related to inflammation, burn or edema. When the procedure is completed they are inadvertently not reattached or cannot be reattached. Since current devices have no means to indicate that they have been removed or to indicate their location, they are lost or forgotten. This is disastrous in situations where patients subsequently require urgent medical attention. Doctors and hospital workers cannot identify the patients quickly without the bands especially when the patient is disoriented or unconscious. In addition, the patients may not be able to identify themselves in such situations as after surgery or during an emergency. Therefore, patients do not receive potentially life-saving or appropriate therapies or treatment such as the wrong blood units or medications that are contra-indicated due to allergy.

Finally, new treatment devices require the presence of the correct patient identification system to initiate treatment. For example, new blood administration devices will not allow administration of the blood without the correct identification code on an ID band. As a result, patients do not receive their medications or transfusions at the required times. In order to address such issues, the JCAHO placed improved patient identification as its number one priority for 2003.

The present invention discloses a system which solves or at least substantially reduces the impact of these problems associated with existing bands in hospitals and other healthcare facilities.

It is one object of the invention to provide a bracelet that is difficult to remove unless removal is authorized. This object is achieved with an identification bracelet that is comprised of material resistant to cutting or tearing, thereby avoiding the problems associated with the easily removable nature of existing bands.

It is another object of the invention to prevent bracelet removal with the use of a lock. Thus, the present invention cannot be removed without an unlocking mechanism thereby saving resources and time.

It is further an object of one embodiment of the invention that the lock on the identification bracelet can only be unlocked by an unlocking device selectively separate from the identification bracelet. As such, removal without a unlocking mechanism on the unlocking device is further prevented.

It is yet another object of the invention to include a patient identifying mechanism on the identification bracelet. Various identification mechanisms may be placed on the bracelet, such as a magnetic marker, a printed sticker or an imprinted/embedded member. In the preferred form of the invention, a barcode system is used.

It is a still further object of another embodiment of the invention to provide a device to determine the duration of disengagement of the identification bracelet from the patient. The present invention solves the problems associated with lost or forgotten bands as previously discussed.

It is yet another object of an embodiment of the invention to provide a device to alert doctors, nurses and other workers that the identification bracelet has been disengaged (i.e. removed from the patient) and for the device to hold the bracelet until it is reattached. Various devices may be utilized, such as an alarm connected to the disengagement duration timer or the lock. This also addresses the loss or misplacement problems associated with current bands.

It is an additional object of another embodiment of the invention to provide a display device on the unlocking device to show various information. It will be appreciated by those skilled in the art that various display devices, such as, LED, TFT or OLED screens may be placed on the unlocking device. The display device can show identification bracelet disengagement duration as well as patient specific information. Hence, a patient can be accurately identified and appropriate care can be given quickly.

The above and other objects, advantages and features of the present invention will become more readily appreciated and understood from a consideration of the following detailed description of preferred embodiments of the present invention when taken together with the accompanying drawings of the present invention.

SUMMARY OF THE INVENTION

In accordance with the foregoing objects, the present invention comprises an identification bracelet that is difficult to remove and has a lock and an identification mechanism. In one embodiment, the lock can only be selectively removed using an unlocking device that is separate from the bracelet. The unlocking device is selectively connected to the identification bracelet. It further comprises an unlocking mechanism such as a key to unlock the identification bracelet lock, a timer device that is initiated when the unlocking device is secured to the identification bracelet and an alert device connected to the timer device. The unlocking device further comprises an LCD screen that displays patient information or disengagement duration.

BRIEF DESCRIPTION OF THE DRAWINGS

The following figures are schematic representations of the invention.

DETAILED DESCRIPTION OF THE INVENTION

While various embodiments of the present invention are discussed in detail below, it should be appreciated that the present invention provides inventive concepts that can be embodied in a wide variety of specific contexts. The specific embodiments discussed are merely illustrative of specific ways to make and use the invention, and do not limit the scope of the invention.

Figure 1:
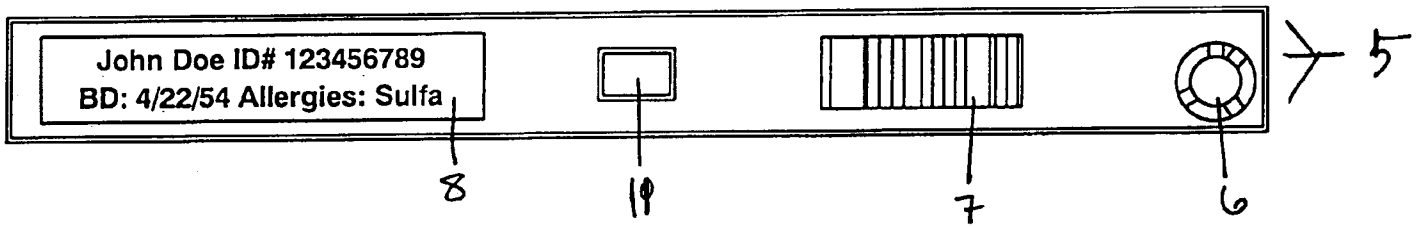
FIG. 1—is a top plan view illustrating the identification bracelet.

Turning first to FIG. 1, there is shown an identification bracelet 5 that is difficult to remove. It is comprised of any hypoallergenic material reasonably resistant to cutting, breaking or tearing (i.e. resistive material) such as strong plastic or TEFLON material made by DuPont in Wilmington, Del. This inhibits inadvertent removal of the bracelet by cutting or tearing. Furthermore, the identification bracelet 5 is ergonomically designed to prevent development of pressure skin sores.

The identification bracelet 5 comprises a lock 6 which may be any commonly found lock. For example, a micro-lock may be used. The lock further inhibits removal by securely fastening the identification bracelet 5 and permits removal only by doctors or workers who poses a key. Moreover, the lock can be re-locked so the identification bracelet 5 can be removed and re-secured. In addition, the identification bracelet 5 comprises a barcode 7 and/or name tag 8. These identification mechanisms, individually or in combination, help doctors, nurses and other workers to accurately identify the patient and administer the desired and correct care.

Figure 2:
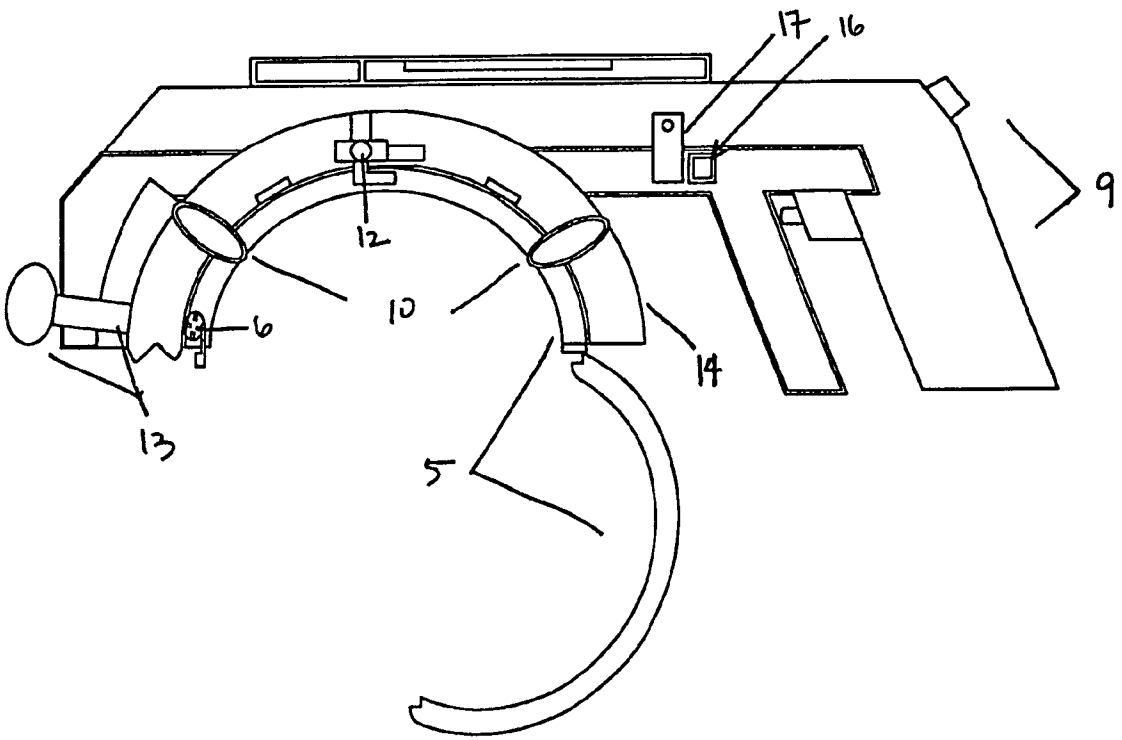
FIG. 2—is a side elevational view illustrating the identification bracelet secured to and unlocked by the unlocking device.

In another embodiment of the invention, as shown in FIG. 2, the system comprises the identification bracelet 5 and an unlocking device 9 separate from the identification bracelet for selectively unlocking the lock 6. The identification bracelet 5 defines a groove 11 (see FIG. 1) to receive the unlocking device 9. The groove 11 mates with a groove latch 12, which secures the unlocking device to the identification bracelet, on an attachment portion 14 of the unlocking device 9. The unlocking device 9 further comprises a C-Clamp 10 on the attachment portion 14 for attachment to the identification bracelet 5. In practice, the identification bracelet 5 is pushed into the C-Clamp 10 and the groove latch 12 is fitted into the groove 11 of the identification bracelet 5, thereby securing the identification bracelet and the unlocking device. The unlocking device 9 can also be used by hospital personnel to initially install the identification bracelet 5 at patient entry points into the hospital.

The unlocking device also comprises an unlocking mechanism 13 that unlocks the lock 6 when properly secured to the identification bracelet 5. As a result, the identification bracelet can only be attached or removed with the unlocking device.

Figure 3:
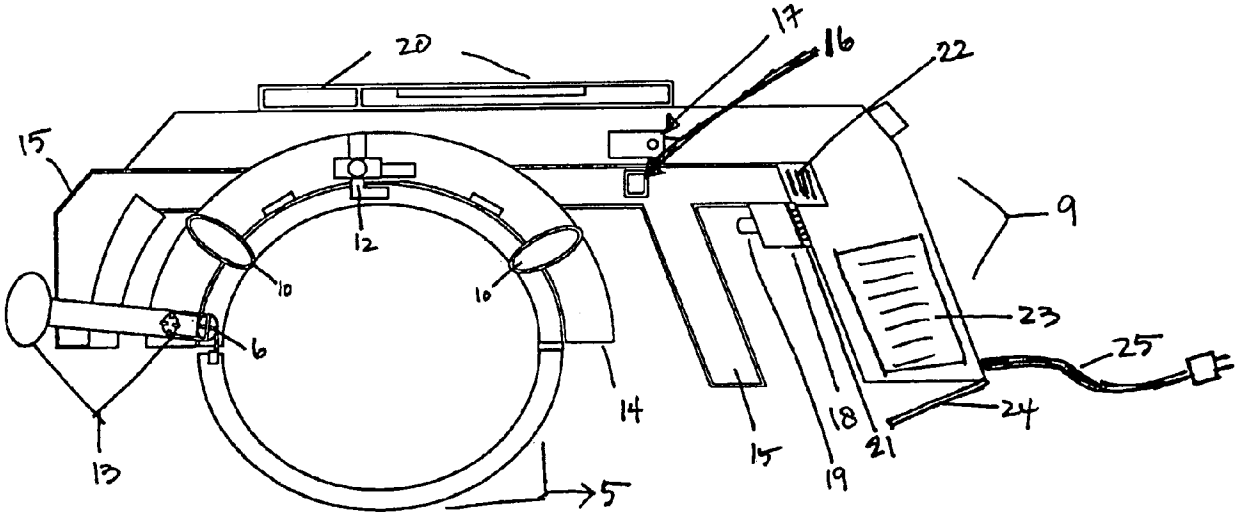
FIG. 3—is a side elevational view illustrating the identification bracelet attached to the unlocking device where the unlocking device is not sufficiently secured to unlock the identification bracelet.
Figure 4:
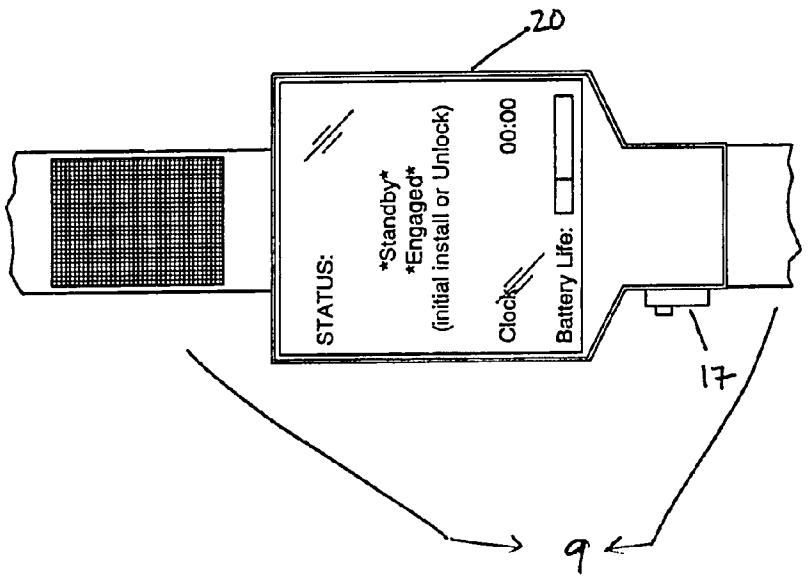
FIG. 4—is a top plan view of the unlocking device with an LCD screen.

Turning to FIG. 3, in the preferred embodiment of the invention, the unlocking device 9 comprises a securing arm 15 having the attachment portion 14 and the unlocking mechanism 13. In use, the identification bracelet 5 is placed and secured in the attachment portion 14 as previously described. However, in the preferred embodiment, the securing arm 15 must be displaced overcoming a specified torsion created by a spring 22 and also secured using a twist lever 17 against a securing protrusion 16 in order for the unlocking mechanism 13 to fully engage the identification bracelet 5 and unlock the lock 6. Coincidentally, when the securing arm 15 is also secured, it depresses a button 19 to initiate a timer 18. When the unlocking device is fully secured to unlock the identification bracelet and the timer is initiated it records the duration the identification bracelet 5 is unlocked or not attached to the patient, is tracked. Moreover, the timer 18 is attached to an alarm or indicator 21 that can be used to sound an alarm or indicate a signal at regular intervals, at a specific time after disengagement of the identification bracelet or to indicate whether the bracelet is removed from the unlocking device 9. It should be appreciated that known timers with alarms or indicators may be used in the present invention. As an example, a fully engaged system with the depressed timer button is shown in FIG. 2 whereas a secured but a non-engaged system is illustrated in FIG. 3. Note that in FIG. 2, the twist lever 17 is secured against the protrusion 16 and the unlocking mechanism 13 is fully secured to the lock 6. However, this state is not present in FIG. 3. In the preferred embodiment, the duration of disengagement of the identification bracelet from the patient can be monitored, a reminder to replace the bracelet can be set, and the location of the bracelet can be identified. An LCD 20 connected to the timer is placed on the unlocking device 9 to display various information such as identification bracelet disengagement time, battery life of the LCD, patient information, etc. Finally, the unlocking device 9 comprises a rechargeable battery 23 to power the LCD 20, timer 18, and the alarm or indicator 21. The rechargeable battery 23 is accessed by cover 24 and is recharged by a power cord 25.

Moreover, sensors may be placed on the unlocking device 9 in various locations to initiate disengagement alarms or signals. For example, laser proximity sensors such as those employed in carpentry related endeavors can be placed on the attachment portion 14 or on the identification bracelet 5 to initiate the alarm when the identification bracelet is prematurely removed from the unlocking device or is away from an appendage of the patient. Additionally, physiological sensors sensitive to changes in physiological conditions such as temperature may also be attached to the unlocking device and utilized in a similar manner. An alert device such as an alarm attached to the lock may be placed on the bracelet itself. Furthermore, those skilled in the art can also appreciate that the battery can be recharged by placing the unlocking device in a recharge base rather than by a power cord attached to the unlocking device. Finally, the unlocking device may also comprise a sophisticated patient information tracking system, i.e. a system that is connected in some manner to a database, has memory, or input means, as found in current, portable patient information management systems. Such sophisticated devices can be used as patient information gathering systems to record specific information such as hospital admission, discharge, hospitalization interval, etc. The specific embodiments discussed in the detailed description are merely illustrative of specific ways to make and use the invention, and do not limit the scope of the invention.

The following is claimed as inventive:

1. A patient identification bracelet comprising, in combination, a re-useable lock;

an identification mechanism;

an unlocking device, separate from said identification bracelet, for selectively unlocking said lock where said unlocking device further comprises a device for tracking the duration of disengagement of said identification bracelet and an alert system to indicate any one of a duration of disengagement, a premature removal of said identification bracelet or a location of said identification bracelet.

2. A patient identification bracelet as in claim 1, where said unlocking device further comprises a display device to show duration of disengagement or patient information.

3. A patient identification system comprising, in combination, an identification bracelet with a lock and an identification mechanism;

a portable unlocking device separate from said identification bracelet to selectively unlock said lock wherein said portable unlocking device comprises a device for tracking duration of disengagement of said identification bracelet; and wherein said portable unlocking device comprises a display device.

4. A patient identification system as in claim 3, further comprising an alarm system connected to said device for tracking duration of disengagement.

5. A patient identification system as in claim 4, further comprising proximity or physiological sensors.

* * * * *